US005901387A

United States Patent [19]

Fan

[11] Patent Number: 5,901,387

[45] Date of Patent: May 11, 1999

[54] SWITCH OF A WATER TAP

[76] Inventor: Chen-Yueh Fan, Room F/23, 4th Fl., No. 5, Sec. 5, Hsinyi Rd., Taipei, Taiwan

[21] Appl. No.: 09/045,856

[22] Filed: Mar. 23, 1998

[51] Int. Cl.[6] ..... E03C 1/01

[52] U.S. Cl. ..... 4/675; 137/625.46

[58] Field of Search ..... 4/675, 678, 601, 4/615, 676; 137/625.46, 876

[56] References Cited

U.S. PATENT DOCUMENTS

| | | | |
|---|---|---|---|
| 2,089,943 | 8/1937 | Busby | 137/625.46 |
| 3,144,873 | 8/1964 | Moore et al. | 4/676 |
| 4,161,191 | 7/1979 | Ranger et al. | 137/625.46 |
| 4,580,600 | 4/1986 | Mazzei et al. | 137/625.46 |
| 5,022,429 | 6/1991 | Rollini et al. | 4/675 |

FOREIGN PATENT DOCUMENTS

| | | | |
|---|---|---|---|
| 3518698 | 11/1986 | Germany | 4/676 |

*Primary Examiner*—Charles R. Eloshway
*Attorney, Agent, or Firm*—Bacon & Thomas, PLLC

[57] ABSTRACT

A switch of a water tap includes a pipe. The pipe includes a cylindrical wall defining a longitudinal bore, and a baffle plate integrally formed with the cylindrical wall and dividing the longitudinal bore into a first section and a second section. The first section has a closed end and two outlets, extending through the cylindrical wall to communicate the first section with respective pipes to a shower head and a tap. The second section has an inlet extending through the cylindrical wall to an interior thereof and close to the baffle plate. The baffle plate defines a pair of through holes. A cylinder is received in the second section of the pipe and in communication with the pipe. The cylinder has a first end which is substantially closed, a second end defining an opening and a circumferential wall extending between the first and second ends. The cylinder further defines a pair of apertures through the first end thereof to correspond to the pair of through holes of the pipe. A first ceramic disk is received in the cylinder and abuts the first end of the cylinder. The first ceramic disk has a pair of bores defined therein to correspond to the pair of apertures of the cylinder. A second ceramic disk is received in the cylinder and abuts the first ceramic disk. The second ceramic disk has an orifice defined therein. The switch further includes a drive mechanism for enabling the orifice of the second ceramic disk to be selectively aligned with one of the pair of bores of the first ceramic disk. By switching the drive mechanism, water can be selectively directed to a shower head and a tap nozzle.

10 Claims, 4 Drawing Sheets

SWITCH OF A WATER TAP

BACKGROUND OF THE INVENTION

1. Field of the Invention

The present invention relates to a switch for a water tap, and more particularly to a tap switch used in bath for selectively directing the flow of water to a either shower nozzle or a tap nozzle, and which is durable and easily operable.

2. Description of Related Art

Water taps are commonly found to be used in a kitchen, in a washbasin, or in a bathtub. A water tap used for a bath generally provides two functions, one of which enables a user to take a bath in a tub and the other enables a user to take a shower. To achieve both of the purposes, a switch is provided for selectively directing the flow of water to enter either a shower nozzle or directly discharging water from the tap. A conventional switch for a water tap was typically configured as a toggle rod. This kind of switch has a disadvantage that a phenomena of friction may occur between the toggle rod and the water tap in operation. This may cause the water tap to be damaged after being used for a long period of time.

The present invention provides a novel switch for a water tap to mitigate and/or obviate the aforementioned problems.

SUMMARY OF THE INVENTION

The main object of the present invention is to provide a water tap switch used in bath for selectively directing the flow of water to a shower nozzle or a tap nozzle, and which is durable and easily operable.

Other objects, advantages and novel features of the invention will become more apparent from the following detailed description when taken in conjunction with the accompanying drawings.

DETAILED DESCRIPTION OF PREFERRED EMBODIMENT

Figure 1:
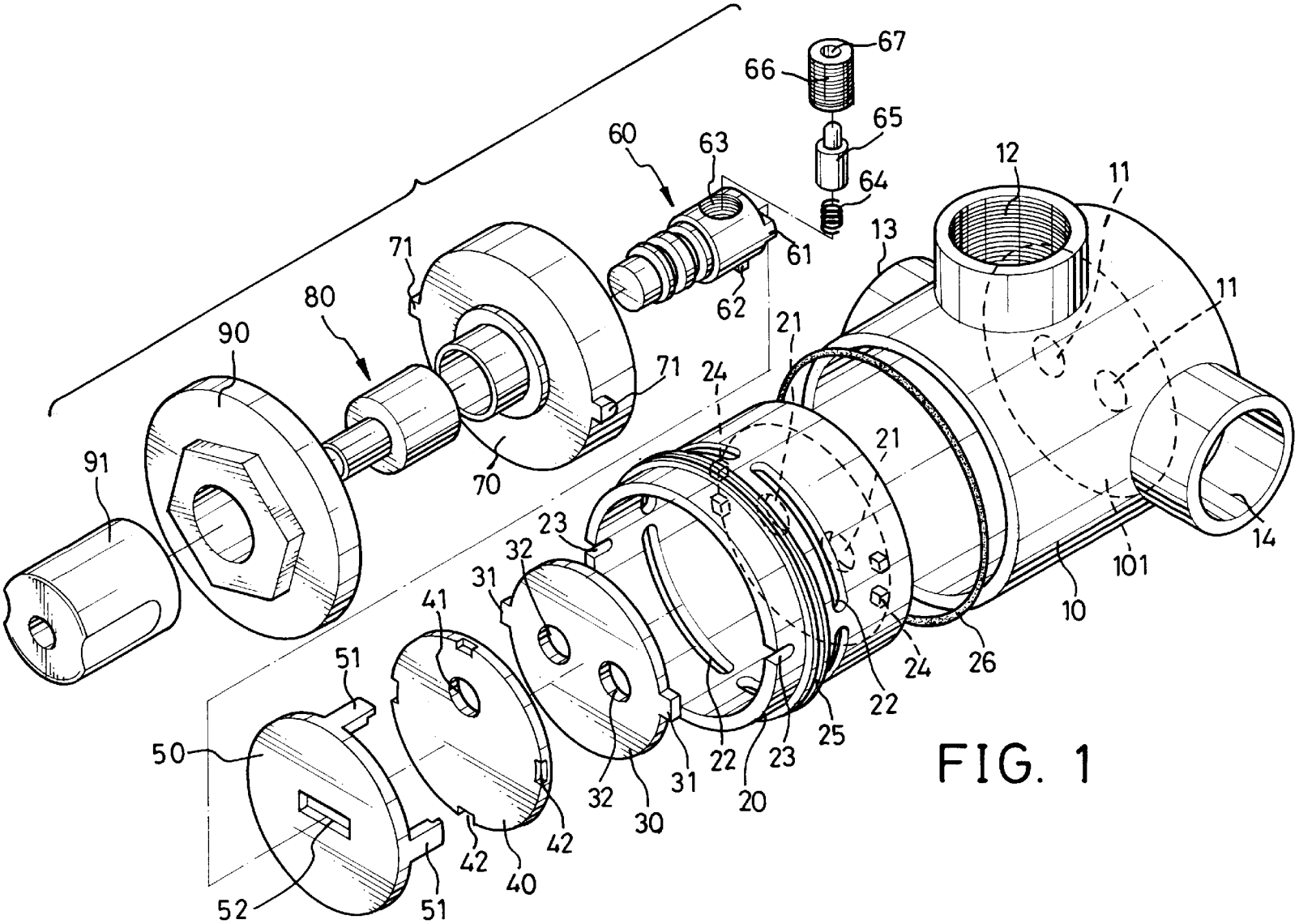
FIG. 1 is an exploded perspective view of a switch for a water tap in accordance with the present invention.
Figure 2:
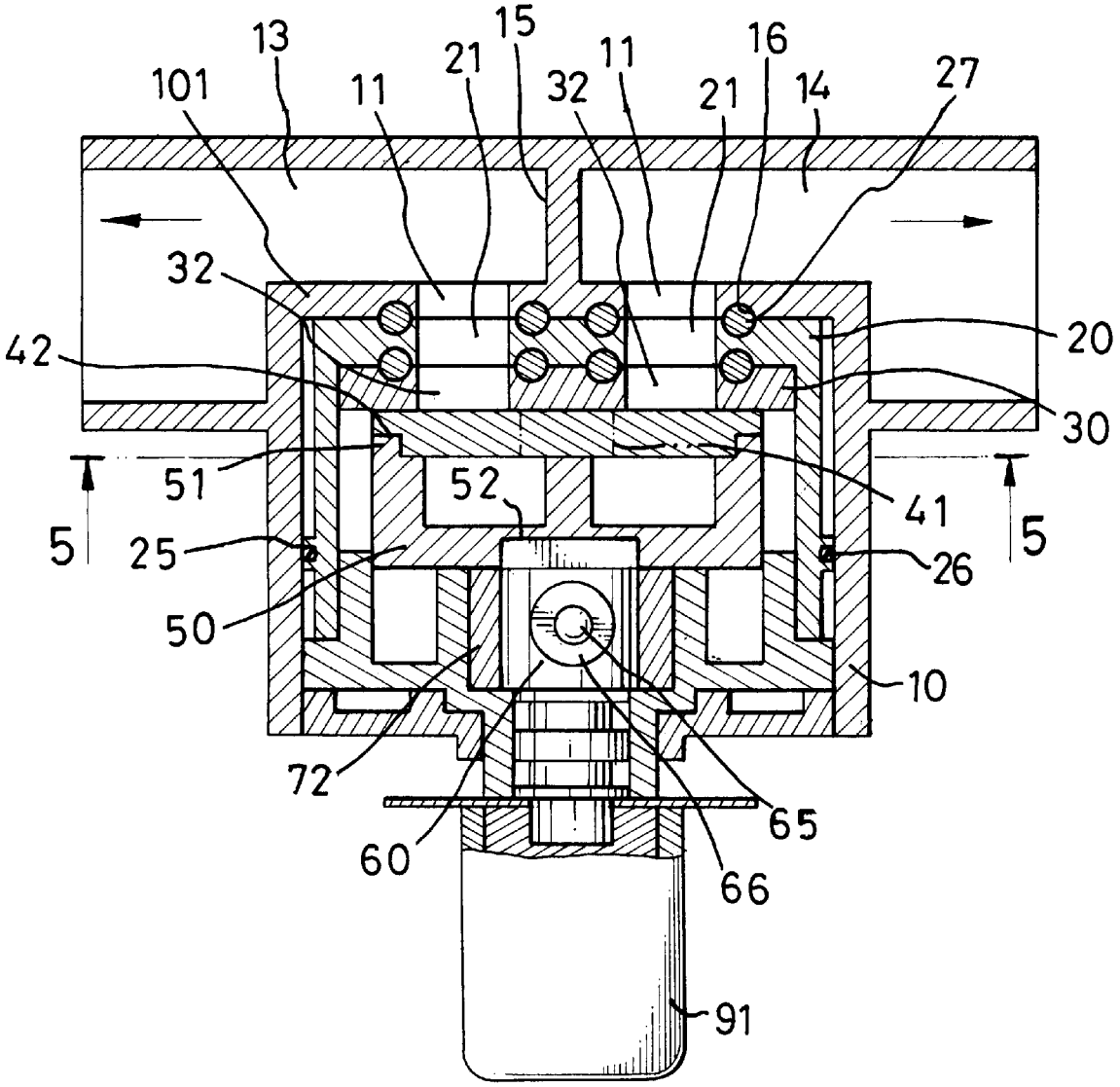
FIG. 2 is a sectional view showing a combined structure of the switch for the water tap in accordance with the present invention.

Referring to FIG. 1 and FIG. 2, a switch for a water tap constructed in accordance with the present invention includes a pipe 10. The pipe 10 includes a cylindrical wall defining a longitudinal bore. A baffle plate 101 is integrally formed with the cylindrical wall and divides the longitudinal bore into a first section and a second section. The first section has a closed end and two outlets 13, 14 extending through the cylindrical wall, thereby communicating the first section with respective pipes to a shower head and a tap. A partition 15 divides the first section to isolate the outlets 13, 14 from each other. An inlet 12 extends through the cylindrical wall into the second section and close to the baffle plate 101. The baffle plate 101 defines a pair of through holes 111. The second section has an entrance 16 at its end opposite to the baffle plate 101.

The switch of the present invention further includes a hollow cylinder 20. The cylinder 20 includes a first end which is substantially closed, a second end defining an opening and a circumferential wall extending between the first and second ends. The first end and the circumferential wall together define a chamber. A plurality of slots 22 are defined through the circumferential wall of the cylinder 20. An annular groove 25 is defined in an outer periphery of the circumferential wall, between the slots 22 and the second end thereof. An O ring 26 is received in and protrudes from the annular groove 25 such that when the cylinder 20 is received in the second section of the bore 15 of the pipe 10, a fluid-tight seal therebetween is achieved. The cylinder 20 further has a pair of apertures 21 defined through the first end thereof to correspond with the pair of holes 11 of the pipe 10, and two pairs of blocks 24 formed oppositely on an internal face of the first end. The cylinder 20 also has a pair of notches 23 oppositely defined in the circumferential wall, at the second end thereof. Each of the holes 11 of the pipe 10 may have defined therearound an O ring groove 16 (see FIG. 2). An O ring 27 is received in and protrudes from each O ring groove 16 to provide a fluid-tight seal between the first end of the cylinder 20 and the baffle plate 101 of the pipe 10.

A durable first ceramic disk 30 is received in the chamber of the cylinder 20 and abuts the first end of the cylinder 20. The first ceramic disk 30 has a pair of lugs 31 oppositely extending from a periphery thereof to be received between each pair of the blocks 24 of the cylinder 20, whereby the first ceramic disk 30 is securely engaged with the cylinder 20. The first ceramic disk 30 further has a pair of bores 32 defined therein to correspond to the pair of apertures 21 of the cylinder 20.

A durable second ceramic disk 40 is also received in the chamber of the cylinder 20 and abuts the first ceramic disk 30. The second ceramic disk 40 defines therein an orifice 41 which is able to be selectively aligned with one of the pair of bores 32 of the first ceramic disk 30. The second ceramic disk 40 further defines a plurality of steps 42 in a periphery thereof.

The switch of the present invention further includes a drive means (not numbered) for enabling the orifice 41 of the second ceramic disk 40 to be selectively aligned with one of the pair of bores 32 of the first ceramic disk 30. The drive means comprises a control plate 50, a locating block 70, a first shaft 60, a second shaft 80 and a cover 90.

The control plate 50 is received in the chamber of the cylinder 20 and engages with the second ceramic disk 40. The control plate 50 has a plurality of legs 51 extending from a periphery thereof to correspondingly engage with the plurality of steps 42 of the second ceramic disk 40 to define a gap (not numbered) between the control plate 50 and the second ceramic disk 40, whereby the second ceramic disk 40 can be rotatably driven by the control plate 50. The control plate 50 further defines a long hole 52 in a center thereof.

The locating block 70 has a pair of lugs 71 oppositely formed on a circumference thereof to be correspondingly received in the pair of notches 23 of the cylinder 20, whereby the locating block 70 can be securely engaged with the cylinder 20. The locating block 70 houses a sleeve 72. Additionally referring to FIG. 3, an inner periphery of the sleeve 72 has an arcuate block 73 formed thereon. The arcuate block 73 defines an arcuate recess 731 in an inner face thereof.

The first shaft 60 is received in the sleeve 72 of the locating block 70 and matingly abuts the arcuate block 73 of the locating block 70. The first shaft 60 has a first end (not numbered) engaged with the control plate 50 and a second end (not numbered) projecting from the sleeve 72 of the locating block 70 and threadedly engaged with a first end of the second shaft 80. The first end of the first shaft 60 has a ridge 61 integrally formed thereon to extend through the long hole 52 of the control plate 50. With this arrangement, the control plate 50 can be rotatably driven by the first shaft 60. The first end of the first shaft 60 further defines a screw hole 63 in a circumference thereof to receive a spring 64 and a post 65 above the spring 64. It is to be noted that the screw hole 63 is configured to be perpendicular to the ridge 61. A bolt 66 with a longitudinal through hole 67 is threadingly received in the screw hole 63. The post 65 is sized to be received in the through hole 67 of the bolt 66 and a tip of the post 65 projects from the longitudinal through hole 67 in virtue of the spring 64. It is to also be noted that the longitudinal through hole 67 is stepped at a top end thereof so that the travel of the post 65 can be limited. In a normal state, the projected tip of the post 65 is received in the arcuate recess 731 of the arcuate block 73 of the locating block 70. In addition, the first shaft 60 has a stopper 62 formed on the circumference thereof opposite to the screw hole 63.

The cover 90 of the drive means defines a cylindrical bore therein for the second shaft 80 to extend therethrough. A knob 91 is mounted to a second end of the second shaft 80 for actuating the first shaft 60 via the second shaft 80.

Figure 3:
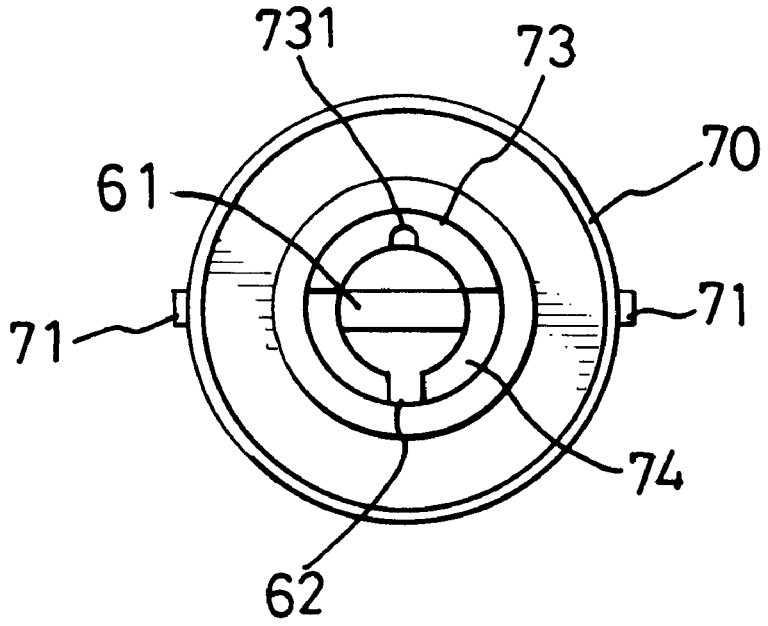
FIG. 3 is a sectional view showing engagement of a locating block and a first shaft of the switch in accordance with the present invention.
Figure 4:
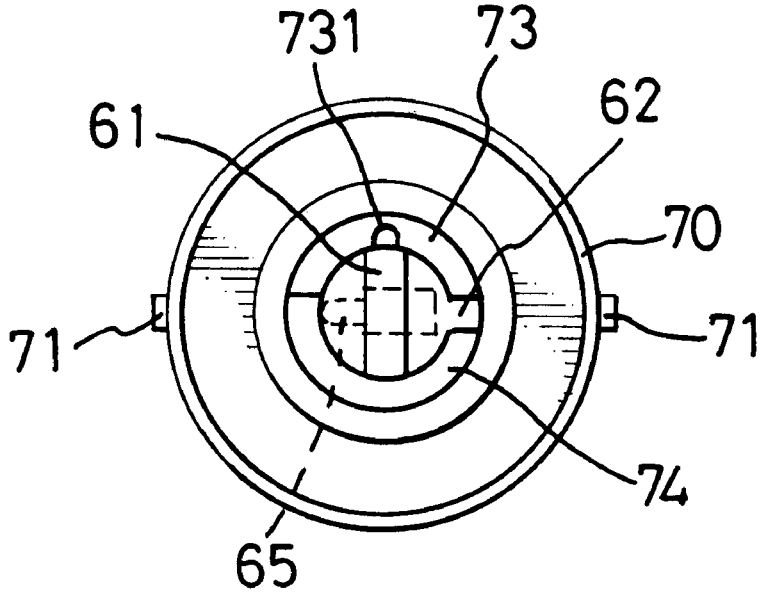
FIG. 4 is a sectional view showing an operation of the first shaft of the switch of FIG. 3.
Figure 5:
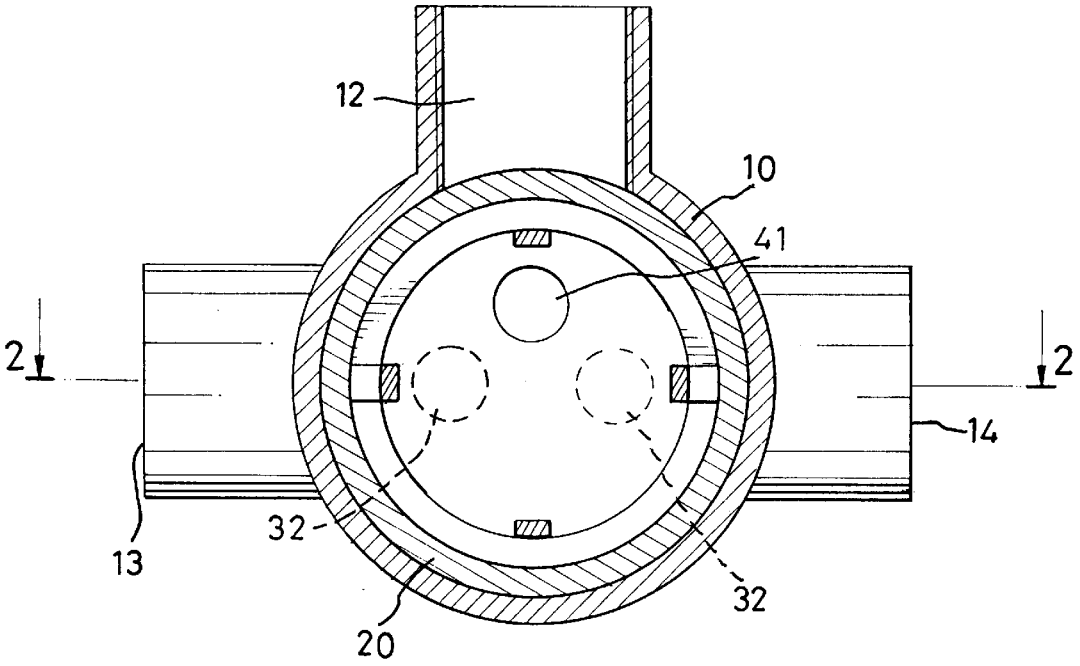
FIG. 5 is a sectional view showing a state of the water tap switch before operation.
Figure 6:
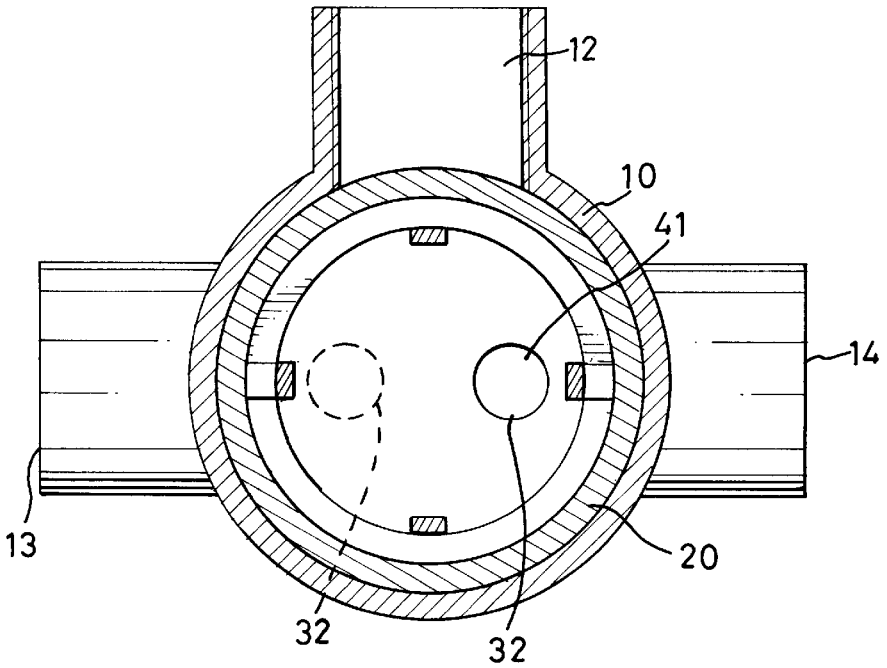
FIG. 6 is a sectional view showing a state of the water tap switch after being switched in accordance with the present invention.

Referring to FIG. 3, as mentioned above, the projected tip of the post 65 is received in the arcuate recess 731 of the locating block 70 in virtue of the spring 64. In such a case, the orifice 41 of the second ceramic disk 40 is not aligned with either the bores 32 of the first ceramic disk 30, as shown in FIG. 5. In other words, water in the cylinder 20 is blocked by the second and first ceramic disk 40, 30 and cannot flow to either of the two outlets 13, 14. Referring to FIG. 4, when the first shaft 60 is actuated to rotate in a counterclockwise direction, the post 65 will be separated from the arcuate recess 731 and the stopper 62 of the first shaft 60 will move along an inner face 74 of the sleeve 72 until it is stopped by an edge (not numbered) of the arcuate block 73. At this time, the first shaft 60 is rotated exactly by an angle of 90 degrees and drives the second ceramic disk 40 via the control plate 50, thereby enabling the orifice 41 of the second ceramic disk 40 to align with one of the pair of bores 32 of the first ceramic disk 30. In this way, water in the cylinder 20 can flow to the shower nozzle through the orifice 41 and the corresponding bore 32. Similarly, the water in the cylinder 20 also can flow to the tap nozzle by actuating the first shaft 60 to rotate in a clockwise direction and enable the orifice 41 to align with the other bore 32, as shown in FIG. 6. It is appreciated that the switch constructed in accordance with the present invention is easily operable. Moreover, the switch is durable as the first and second ceramic disks 30, 40 are durable.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A switch of a water tap, comprising:

a pipe including a cylindrical wall defining a longitudinal bore, and a baffle plate integrally formed with the cylindrical wall and dividing the longitudinal bore into a first section and a second section, said first section having a closed end and two outlets extending through the cylindrical wall to communicate the first section with respective pipes to a shower head and a tap, said two outlets being isolated from each other by a partition, said second section defining an entrance at its end opposite to the baffle plate and having an inlet extending through the cylindrical wall to an interior thereof and close to the baffle plate, said baffle plate defining a pair of through holes;

a hollow cylinder received in the second section of the pipe and in communication with the pipe, said cylinder having a first end which is substantially closed, a second end defining an opening and a circumferential wall extending between the first and second ends, said cylinder further defining a pair of apertures through the first end thereof to correspond to the pair of through holes of the pipe, a first ceramic disk received in the cylinder and abutting the first end of the cylinder, said first ceramic disk having a pair of bores defined therein to correspond to the pair of apertures of the cylinder;

a second ceramic disk received in the cylinder and abutting the first ceramic disk, said second ceramic disk having an orifice defined therein to selectively align with one of the pair of bores of the first ceramic disk; and a drive means for enabling the orifice of the second ceramic disk to be selectively aligned with one of the pair of bores of the first ceramic disk.

2. A switch for a water tap as claimed in claim 1, wherein said drive means includes:

a control plate received in the cylinder and engaged with the second ceramic disk;

a locating block securely engaged with the cylinder and housing a sleeve, an inner periphery of the sleeve having an arcuate block formed thereon, said arcuate block defining an arcuate recess in an inner face thereof;

a first shaft received in the locating block and movably engaged with the arcuate block, said first shaft having a first end engaged with the control plate and a second end projecting from the locating block;

a second shaft having a first end threadingly engaged with the first shaft; and a cover having a cylindrical bore to be extended through by the second shaft, and a knob engaged with a second end of the second shaft for actuating the first shaft.

3. A switch for a water tap as claimed in claim 2, wherein said control plate has a plurality of legs extending from a periphery thereof and said second ceramic disk defines a plurality of steps in a periphery thereof to receivably engage with the plurality of legs, whereby the second ceramic disk can be rotatably driven by the control plate.

4. A switch for a water tap as claimed in claim 2, wherein said locating block has a pair of lugs oppositely extending from a circumference thereof and said cylinder defines a pair of notches in said second end thereof to receivably and respectively engage with the pair of lugs of the locating block.

5. A switch for a water tap as claimed in claim 2, wherein said first end of the first shaft has a ridge integrally formed thereon to extend through a hole in the control plate.

6. A switch for a water tap as claimed in claim 2, wherein said first end of the first shaft includes a screw hole defined in a circumference thereof to receive a spring and a post above the spring, and a bolt threadingly received in the screw hole and defining a longitudinal through hole therein for the post to extend therethrough, said post being sized to be received in the longitudinal through hole and its travel being limited by the longitudinal through hole, a tip of the post projecting from the longitudinal through hole and being selectively and receivably located in the arcuate recess of the locating block.

7. A switch for a water tap as claimed in claim 1, wherein said cylinder defines a plurality of slots through the circumferential wall thereof to communicate with the pipe.

8. A switch for a water tap as claimed in claim 7, wherein said cylinder further defines an annular groove in an outer periphery of the circumferential wall, between the slots and the second end thereof, such that a first O ring can be received therein and protrudes therefrom to achieve a fluid-tight seal between the cylinder and the pipe.

9. A switch for a water tap as claimed in claim 1, wherein each of the holes of the pipe may have defined therearound an O ring groove and a second O ring is received in and protrudes from each O ring groove to provide a fluid-tight seal between, the first end of the cylinder and the baffle plate of the pipe.

10. A switch for a water tap as claimed in claim 1, wherein said cylinder further has two pairs of blocks formed oppositely on an inner face of the first end and said first ceramic disk has a pair of lugs oppositely extending from a periphery thereof to be received between each pair of blocks of the cylinder, thereby securely engaging with the cylinder.

* * * * *